US009889662B2

(12) United States Patent
Matsufuji

(10) Patent No.: US 9,889,662 B2
(45) Date of Patent: Feb. 13, 2018

(54) LIQUID DROPLET DISCHARGING HEAD AND IMAGE FORMING APPARATUS, INCLUDING DISPLACING FILM THAT APPLIES SELF-DISPLACEMENT TO APPLY PRESSURE TO LIQUID INSIDE CHAMBER

(71) Applicant: Ryohta Matsufuji, Kanagawa (JP)

(72) Inventor: Ryohta Matsufuji, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/291,522

(22) Filed: Oct. 12, 2016

(65) Prior Publication Data

US 2017/0120585 A1 May 4, 2017

(30) Foreign Application Priority Data

Nov. 2, 2015 (JP) ..... 2015-215738

(51) Int. Cl.
*B41J 2/145* (2006.01)
*B41J 2/14* (2006.01)

(52) U.S. Cl.
CPC ..... *B41J 2/145* (2013.01); *B41J 2/1433* (2013.01)

(58) Field of Classification Search
CPC ..... B41J 2/14201; B41J 2/14209; B41J 2/14233; B41J 2/14274
See application file for complete search history.

(56) References Cited

U.S. PATENT DOCUMENTS 8,167,420 B2 * 5/2012 Hibi ..... B41J 2/055 347/68
2006/0007272 A1 1/2006 Ogata et al.
2008/0180469 A1 * 7/2008 Katayama ..... B41J 2/14233 347/1
2015/0077469 A1 3/2015 Kohda et al.

FOREIGN PATENT DOCUMENTS

JP 9-141856 6/1997
JP 9-141857 6/1997
JP 2004-299345 10/2004
JP 2010-188547 9/2010
JP 2010-194797 9/2010

* cited by examiner

*Primary Examiner* — Juanita D Jackson
(74) *Attorney, Agent, or Firm* — Cooper & Dunham LLP

(57) ABSTRACT

A liquid droplet discharging head includes discharging orifices to discharge a liquid droplet, pressure generating chambers to apply a pressure to liquid inside the liquid droplet discharging head, a common liquid supplying chamber to accommodate the liquid to the pressure generating chambers, individual supplying paths to communicate the pressure generating chambers with the common liquid supplying chamber, a displacing film for discharging to conduct self displacement to individually apply a pressure to the liquid inside the pressure generating chambers to discharge the liquid from the discharging orifices, a liquid supplying chamber displacing film to conduct self displacement according to a pressure change of the liquid in the common liquid supplying chamber, and individual supplying holes existing at each border between the individual supplying paths and the common liquid supplying chamber and facing the liquid supplying chamber displacing film via the liquid in the common liquid supplying chamber.

13 Claims, 13 Drawing Sheets

LIQUID DROPLET DISCHARGING HEAD AND IMAGE FORMING APPARATUS, INCLUDING DISPLACING FILM THAT APPLIES SELF-DISPLACEMENT TO APPLY PRESSURE TO LIQUID INSIDE CHAMBER

CROSS-REFERENCE TO RELATED APPLICATIONS

This patent application is based on and claims priority pursuant to 35 U.S.C. § 119 to Japanese Patent Application No. 2015-215738, filed on Nov. 2, 2015, in the Japan Patent Office, the entire disclosure of which is hereby incorporated by reference herein.

BACKGROUND

Technical Field

The present invention relates to a liquid droplet discharging head and an image forming apparatus.

Description of the Related Art

Image forming apparatuses are known which include a plurality of pressure generating chambers to communicate with a plurality of discharging orifices and apply a pressure to liquid, a common liquid supplying chamber to accommodate the liquid to be supplied to these pressure generating chambers, and a plurality of individual supplying paths which individually communicates the pressure generating chambers with the common liquid supplying chamber.

For example, an inkjet head operating as a liquid droplet discharging head includes a plurality of nozzle holes serving as discharging orifices and a plurality of cavity chambers serving as pressure generating chambers which individually communicate with the nozzles to apply a pressure to ink as liquid. In addition, the inkjet head further includes an ink manifold serving as a common liquid supplying chamber to accommodate ink to be supplied to the cavity chambers and a plurality of individual supplying paths which individually communicates the cavity chambers with the manifold. Moreover, the inkjet head also includes vibration plates constituting part of the inside wall of the cavity chambers or the ink manifold. Of all the areas of the vibration plates along the plane direction, the areas forming the inside wall of the cavity chambers increase or decrease the pressure to the ink in the cavity chambers according to the vibration of the vibration plate. In addition, of all the areas, the areas forming the inside wall of the ink manifold serve as a damper portion which is displaced according to the pressure change of the ink in the ink manifold.

As the ink in the cavity chambers is pressurized by the drive of a piezoelectric element, the ink is discharged as a form of ink droplets from a nozzle hole, part of which communicates with the cavity chamber. At this time, part of the ink in the individual supplying path communicating with the cavity chamber moves back from the individual supplying path to the ink manifold to pressurize the ink in the manifold. As the pressurization to the ink in the cavity chamber ceases when the drive of the piezoelectric element stops, the pressure of the ink in the cavity chamber is back to the original value. At this time, if the ink in the ink manifold under pressure rushes back to the individual supplying path as reflective wave, the pressure of the ink in the cavity chamber takes a long time to be back. The damper portion is displaced to the direction in which the volume of the ink manifold increases when the ink in the individual supplying paths moves back to the ink manifold at the time of drive of the piezoelectric element. This is said to make it possible to reduce the rush of the reflective wave.

However, to displace the damper portion in response to slight pressure changes of the ink in the ink manifold in this inkjet head, the thickness of the damper portion is required to be extremely thin. This leads to a problem that the damper portion is easily broken because the mechanical strength is decreased.

SUMMARY

According to the present invention, provided is an improved liquid droplet discharging head including a plurality of discharging orifices to discharge a liquid droplet, a plurality of pressure generating chambers that individually communicate with the plurality of discharging orifices, the plurality of pressure generating chambers to apply a pressure to liquid inside the liquid droplet discharging head, a common liquid supplying chamber to accommodate the liquid to be supplied to the plurality of pressure generating chambers, a plurality of individual supplying paths to communicate the plurality of pressure generating chambers with the common liquid supplying chamber, a displacing film for discharging which constitutes part of the inside wall of each of the plurality of pressure generating chambers, in order to conduct self displacement to individually apply a pressure to the liquid inside the plurality of pressure generating chambers to discharge the liquid from the plurality of discharging orifices, a liquid supplying chamber displacing film which constitutes part of an inside wall of the common liquid supplying chamber, in order to displace itself according to a pressure change of the liquid in the common liquid supplying chamber, and a plurality of individual supplying holes existing at each border between the plurality of individual supplying paths and the common liquid supplying chamber, the plurality of individual supplying holes facing the liquid supplying chamber displacing film via the liquid in the common liquid supplying chamber.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
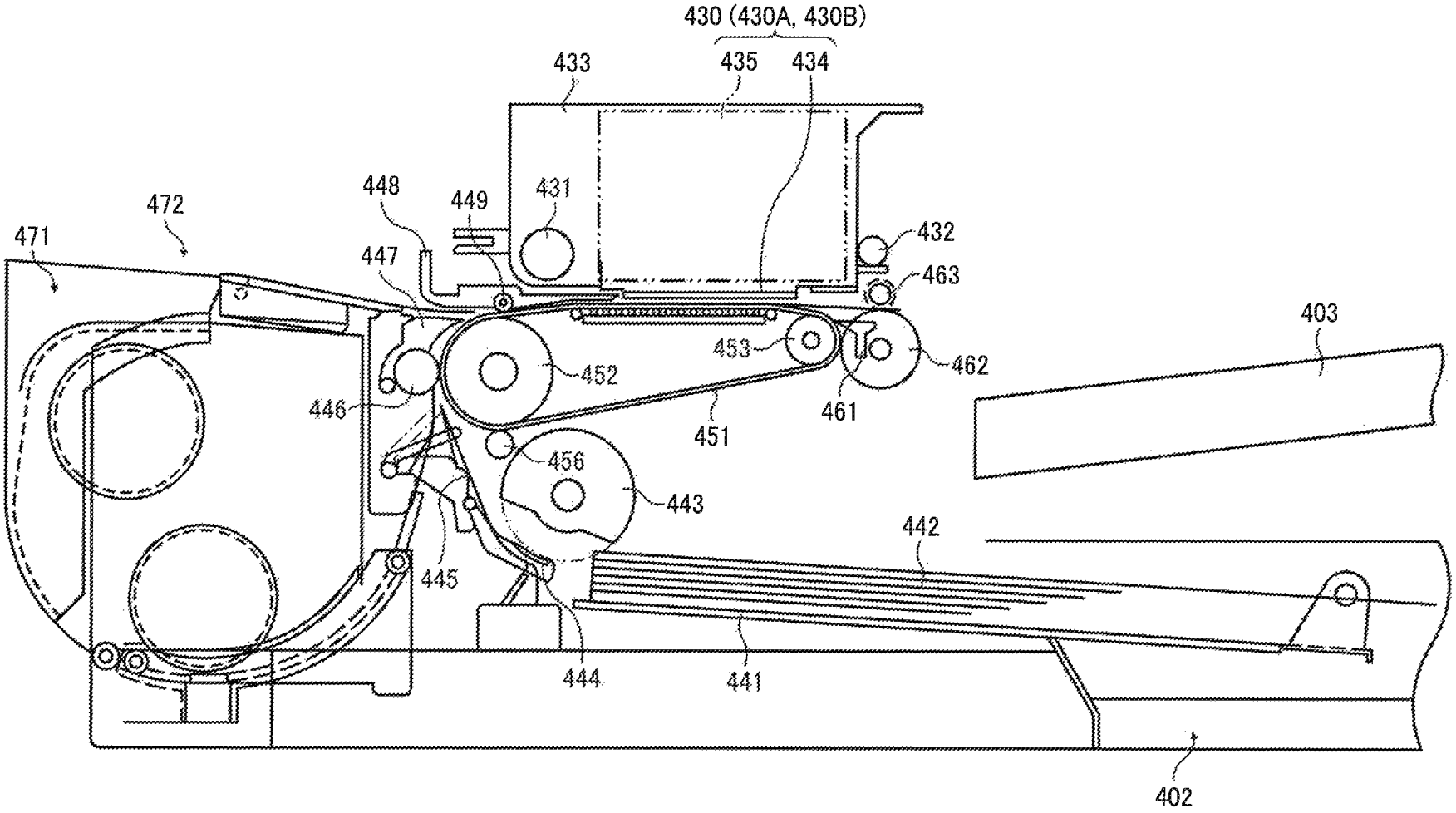
FIG. 1 is a diagram illustrating the configuration of an image forming apparatus according to an embodiment of the present disclosure.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

A first embodiment of the image forming apparatus to which the present disclosure is applied is described next.

"Recording sheet" is not limited to paper in terms of material, but includes transparent sheets, cloth, glass, substrates, others to which ink droplets and other liquid can be attached, and articles referred to as a recording medium, a recording sheet, recording paper, etc. Moreover, image forming, recording, and printing represent the same meaning.

In addition, the image forming apparatus forms images by discharging a liquid onto a medium such as paper, thread, fabric, cloth, leather, metal, plastic, glass, wood, and ceramic. Moreover, the image forming includes providing not only an image carrying a meaning such as texts or figures but also an image carrying no meaning such as a pattern to a recording medium (i.e., simply landing droplets on a medium).

In addition, the ink is not limited to just an article referred to as ink but means a generic term for liquid capable of forming images, referred to as a recording fluid, fixing processing fluid, liquid, etc. unless otherwise specified. For example, DNA samples, resists, pattern materials, and resins are included. The fluid for use in the image forming apparatus is not limited to the recording fluid or ink but includes any material which is liquid when discharged. In addition, the liquid droplet discharging device discharges liquid from a liquid droplet discharging head and includes all of the devices such as typical recording devices, printing devices, image forming apparatuses, droplet discharging devices, liquid discharging devices, process liquid applicators, and 3D manufacturing devices.

In addition, the image is not limited to two-dimensional but includes an image applied to a sterically formed article and an image formed by modeling a three-dimensional object itself.

In addition, the image forming apparatus includes both a serial type image forming apparatus and a line type image forming apparatus unless otherwise specified. In the serial type image forming apparatus, a liquid droplet discharging head carried by a carriage is moved in the main scanning direction perpendicular to the sheet conveyance direction for recording. In addition, the line type image forming apparatus uses a line type head including multiple discharging orifices (nozzles) disposed in line to discharge liquid droplets over significantly the full width of the recording area. In the first embodiment, the serial type is taken but the present disclosure is not limited thereto.

The liquid droplet discharging head is typified into several types according to the kinds of actuator devices to discharge ink droplets (recording fluid). For example, liquid droplet discharging heads employing a piezoelectric method are usable. In this method, a thin vibration plate constitutes part of the wall of a liquid chamber and a piezoelectric element as the electromechanical transduction element is correspondingly disposed. Due to deformation of the piezoelectric element upon application of a voltage, the vibration plate is deformed in order to change the pressure in the pressure generating chamber, thereby discharging ink droplets. In addition, liquid droplet discharging heads employing BUBBLE JET™ method are usable. In this method, electric heating elements are disposed inside liquid chambers and heated by electric current to produce air bubbles in the chambers. Due to the pressure of the air bubbles, ink droplets are discharged. Also, liquid droplet discharging heads utilizing electrostatic are usable. In this method, an electric field is applied between a vibration plate forming part of the wall of a liquid chamber and an individual electrode disposed outside the liquid chamber facing the vibration plate to deform the vibration plate, thereby changing the pressure and the volume in the liquid chamber. As a result, ink droplets are discharged from nozzles. In the first embodiment, the piezoelectric method is adopted but the present disclosure is not limited to the piezoelectric method.

Figure 2:
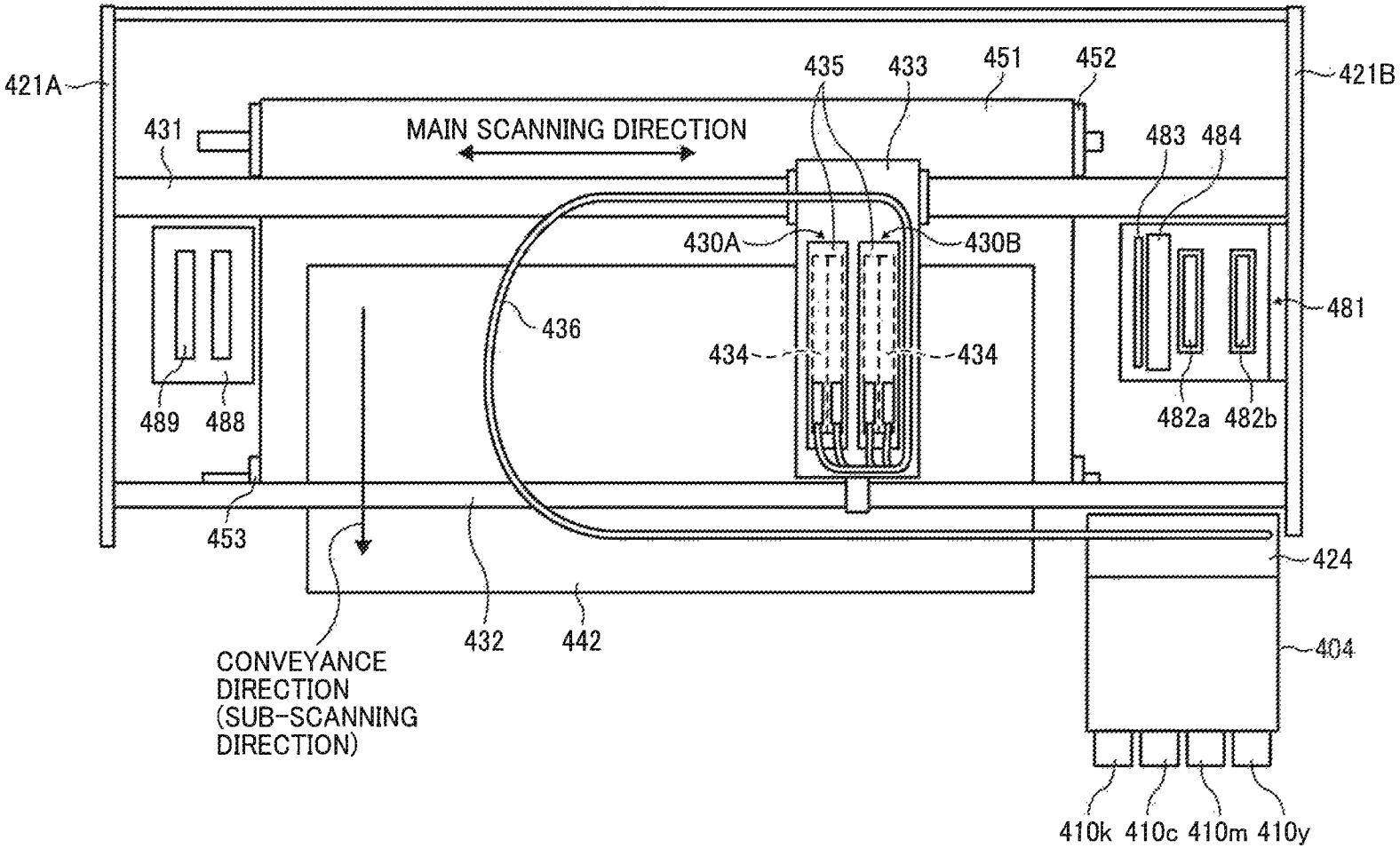
FIG. 2 is a planar view of the configuration illustrated in FIG. 1.

The fundamental configuration of the image forming apparatus according to the first embodiment is described below. FIG. 1 is a diagram illustrating the configuration of an image forming apparatus according to an embodiment of the first disclosure. FIG. 2 is a planar view of the configuration illustrated in FIG. 1.

The image forming apparatus according to the first embodiment is a serial type inkjet recording apparatus. A primary guide rod 431 and sub-guide rod 432 laterally bridged between side plates 421A and 421B on the right side and the left side support a carriage 433 in such a manner that the carriage 433 can reciprocate in the main scanning direction (indicated by an arrow). This carriage 433 carries two liquid droplet discharging units 430 (430A and 430B) each of which integrates a liquid droplet discharging head 434 as a liquid discharging member and a head tank as a sub-tank to supply liquid to the liquid droplet discharging head 434. The liquid droplet discharging head 434 includes nozzle lines having multiple nozzles (discharging orifices). The nozzle lines are arranged in the sub-scanning direction (longitudinal direction of the liquid droplet discharging head) perpendicular to the main scanning direction with the liquid droplet discharging direction downward.

Each of the two liquid droplet discharging units 430A and 430B has two nozzle lines. The liquid droplet discharging head 434 of the liquid droplet discharging unit 430A discharges ink droplets of black (K) from each nozzle on one nozzle line and ink droplets of cyan (C) from each nozzle on the other nozzle line. The liquid droplet discharging head 434 of the liquid droplet discharging unit 430B discharges ink droplets of magenta (M) from each nozzle on one nozzle line and ink droplets of yellow (Y) from each nozzle on the other nozzle line.

The image forming apparatus according to the embodiment discharges four color ink droplets using two liquid droplet discharging heads. Also, it is possible to have a configuration of four nozzle lines arranged in a single liquid droplet discharging head from which four color ink is discharged. In addition, "integration" in the liquid droplet discharging units 430A and 430B means that the liquid droplet discharging head 434 and the head tank 435 are mutually fixed with a fastening member or an adhesive directly to or via a filter member. Alternatively, it means that the liquid droplet discharging head 434 and the head tank 435 are connected to each other with a tube, etc.

Main tanks 410*k*, 410*c*, 410*m*, and 410*y* as liquid cartridges of each color are detachably attached to a cartridge holder 404. A liquid sending unit 424 including a liquid sending pump sends each color ink from the main tanks 410*k*, 410*c*, 410*m*, and 410*y* of each color to the head tank 435 of each of the liquid droplet discharging units 430A and 430B via a supplying tube 436 for each color The image forming apparatus according to the first embodiment includes a sheet-feeding unit to feed recording sheets 442 as recording media stacked on a sheet accommodating unit 441 of a sheet feeding tray 402. This sheet-feeding unit is formed of a sheet-feeding roller 443 to separate and feed the recording sheet 442 one sheet by one sheet from the sheet accommodating unit 441, a separating pad 444 facing the sheet-feeding roller 443, etc.

In addition, the image forming apparatus according to the embodiment includes a guide 445, a counter roller 446, a conveying guide member 447, and a pressing member 448 having a front end pressurizing roller 449, which convey and guide the fed recording sheet 442. Moreover, the image forming apparatus includes conveyor belt 451 as a conveying device to suction and convey the fed recording sheet 442 at a position facing the liquid droplet discharging head 434 of the liquid droplet discharging unit 430.

The conveyor belt 451 is an endless-form belt, stretched between a conveyor roller 452 and a tension roller 453 and configured rotatable in the belt conveying direction (sub-scanning direction). This conveyor belt 451 uses an electrostatic belt charged by a charging roller 456 as a charging device. The conveyor belt 451 may use air suction. In addition, as the conveyor device, it is possible to use a roller instead of a conveyor belt.

A stripping claw 461 to separate the recording sheet 442 from the conveyor belt 451, an ejection roller 462, and an ejection roller 463 are situated downstream of the tension roller 453 around which the conveyor belt is stretched. Also, a sheet ejection tray 403 is located below the ejection roller 462. A double-face print unit 471 is mounted onto the rear side of the inkjet recording device in a detachable manner. The double-face print unit 471 takes in and reverses the recording sheet 442 returned by the reverse rotation of the conveyor belt 451 and feeds the recording sheet 442 again between the counter roller 446 and the conveyor belt 451. In addition, the upper surface of the double-face print unit 471 serves as a bypass tray 472. Furthermore, a maintenance and recovery mechanism 481 is disposed in the non-image forming area on one side of the carriage 433 in the scanning direction to maintain and recover the state of the nozzle of the liquid droplet discharging head 434 in the liquid droplet discharging units 430A and 430B.

This maintenance and recovery mechanism 481 includes caps 482*a* and 482*b* to cap the nozzle surfaces of the liquid droplet discharging head 434. In addition, the maintenance and recovery mechanism 481 includes a blade member 483 to wipe the nozzle surface. Moreover, the maintenance and recovery mechanism 481 includes a dummy-discharging receiver 484 to receive thickened ink discharged by dummy-discharging not contributing to image forming. In addition, in the non-image forming areas on the other side of the carriage 433 in the scanning direction, a dummy-discharging receiver 488 is disposed to receive ink discharged by dummy discharging during image forming. This dummy-discharging receiver 488 includes holes 489 along the nozzle arrangement direction of the liquid droplet discharging head 434.

In this image forming apparatus according to the embodiment, the recording sheet 442 is separated and fed from the sheet feeding tray 402 one sheet by one sheet. The recording sheet 442 is substantially perpendicularly fed upward, guided by the guide 445, and conveyed being pinched between the conveyor belt 451 and the counter roller 446. Furthermore, the front end of the recording sheet 442 is guided by a conveyor guide and pressed against the conveyor belt 451 by the front end pressurizing roller 449 to change the conveyor direction substantially 90 degrees. When the recording sheet 442 is fed onto the charged conveyor belt 451, the recording sheet 442 is suctioned to the conveyor belt 451 and conveyed thereon in the sub-scanning direction by the circulation movement of the conveyor belt 451. Due to the drive of the liquid droplet discharging heads 434 of the liquid droplet discharging units 430A and 430B in response to image signals while moving the carriage 433, ink is discharged onto the sheet 442 which stands still to record an image corresponding to an amount of a single line. After the recording sheet 442 is conveyed in a predetermined amount, the image for the next line is formed. On receiving a signal indicating that the recording has completed or the rear end of the recording sheet 442 has reached the image recording area, the recording operation stops and the recording sheet 442 is ejected to the sheet ejection tray 403.

Figure 3:
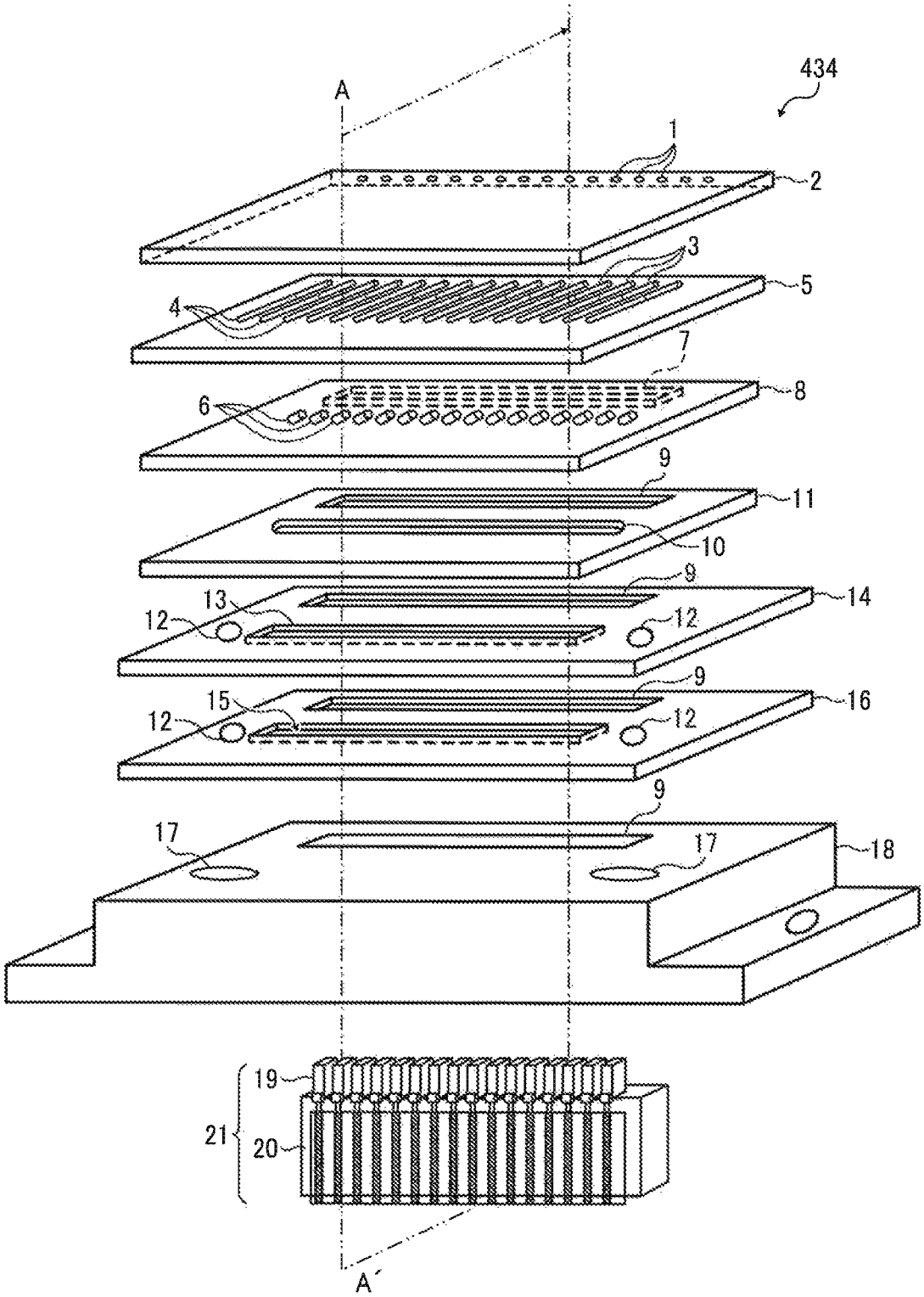
FIG. 3 is an exploded perspective view of an example of a liquid droplet discharging head of the image forming apparatus according to an embodiment of the present disclosure.
Figure 4:
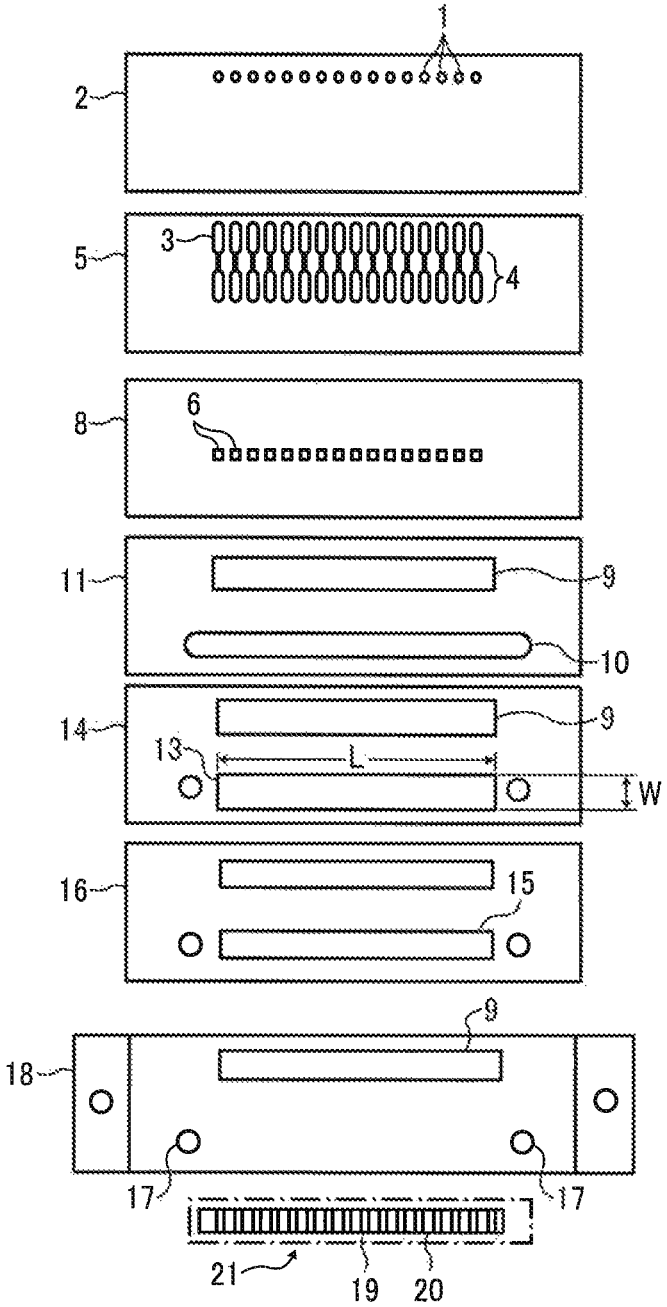
FIG. 4 is an exploded planar view of each plate-like form member of the liquid droplet discharging head illustrated in FIG. 3 from the nozzle side.
Figure 5:
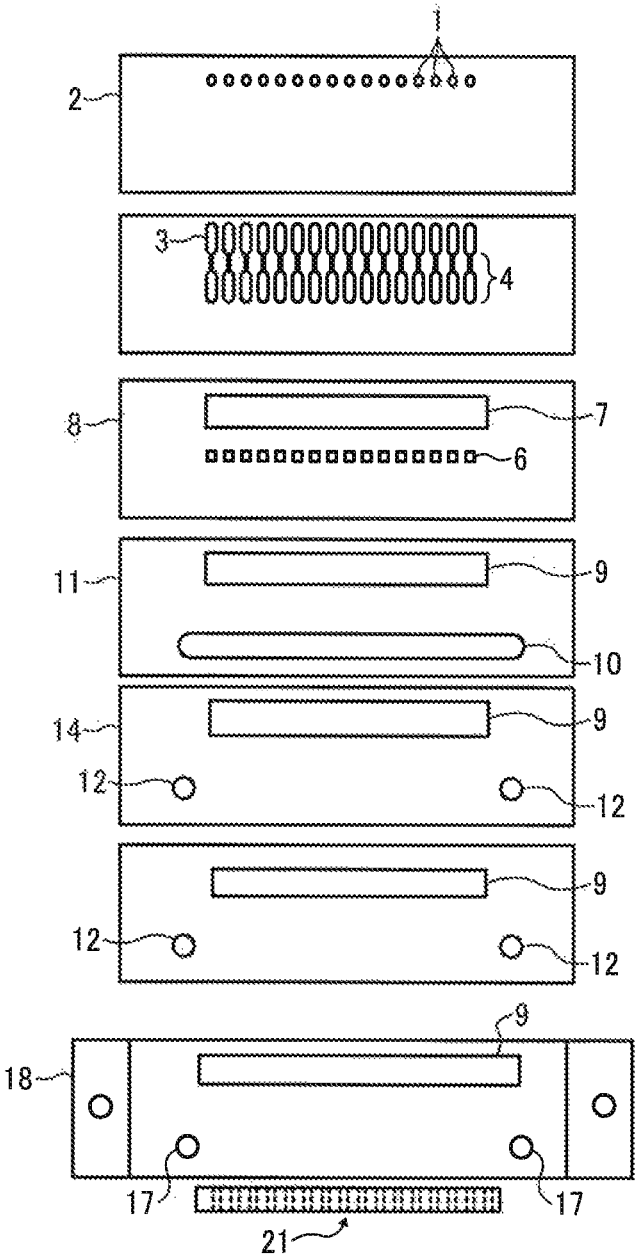
FIG. 5 is an exploded planar view of each plate-like form member of the liquid droplet discharging head illustrated in FIG. 3 from the layered piezoelectric element side.
Figure 6:
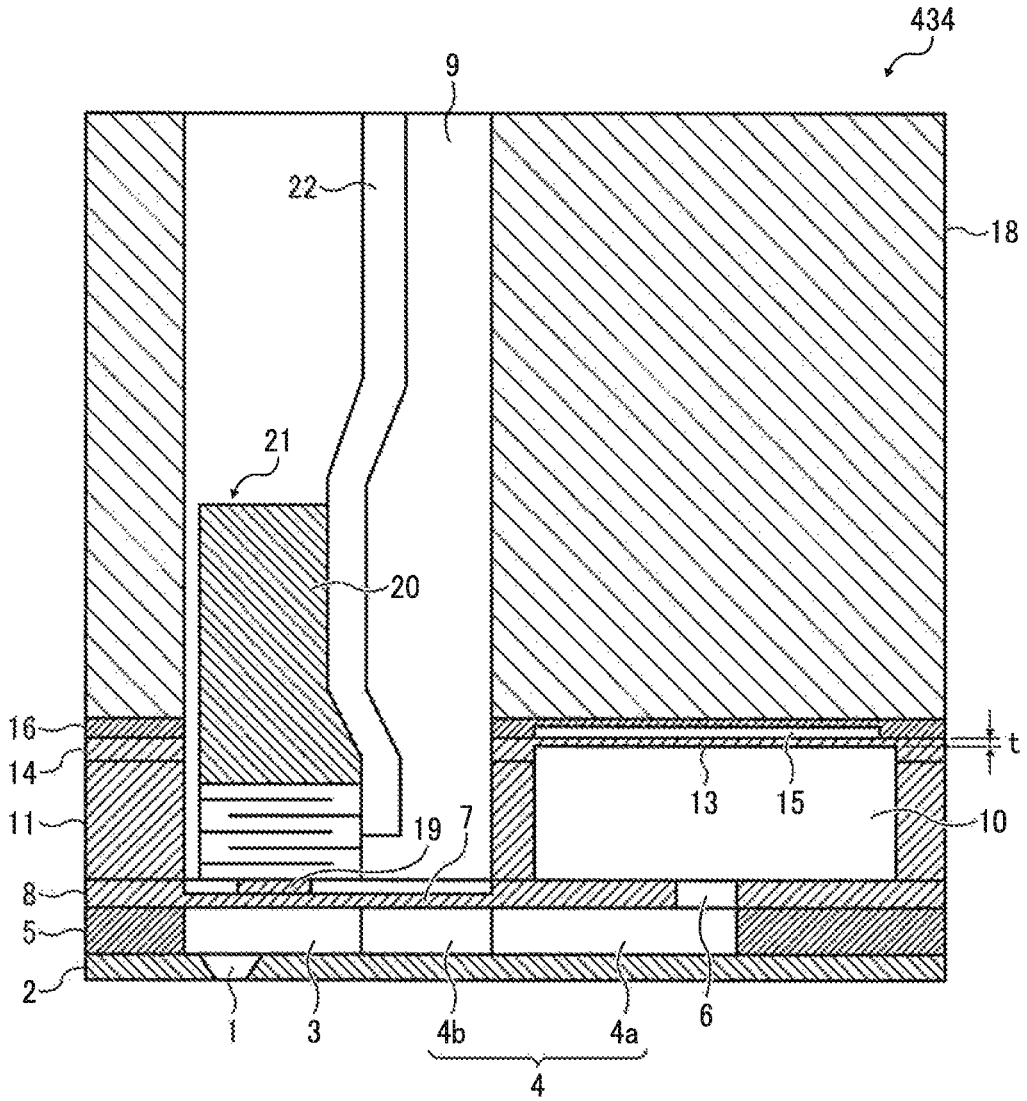
FIG. 6 is an A-A' cross section illustrating the liquid droplet discharging head illustrated in FIG. 3.

FIG. 3 is an exploded perspective view of the liquid droplet discharging head 434. FIG. 4 is an exploded planar view of each plate-like form member of the liquid droplet discharging head 434. FIG. 5 is an exploded planar view of each plate-like form member of the liquid droplet discharging head 434 from the layered piezoelectric element side. FIG. 6 is an A-A' cross section illustrating the liquid droplet discharging head 434 illustrated in FIG. 3.

In these drawings, nozzles 1 as multiple discharging orifices (slits) are formed in a nozzle plate 2 as a discharging orifice forming member. The nozzle plate 2 is made of stainless plate. The processing accuracy of slit (through hole) as the nozzle 1 has a large impact on the discharging property of the liquid droplet discharging head 434. To reduce variation of the dimension accuracy among the plurality of nozzles 1, multiple slits of the nozzle plate 2 are required to be processed with a high precision. Therefore, the multiple slits of the nozzle plate 2 is formed of a pressing process method, a laser process method, an electrocasting method of nickel, etc.

A plurality of pressure generating chambers 3 and a plurality of individual supplying paths 4 individually communicating with the pressure generating chambers 3 have sides formed with slits made to a flow passage plate 5. Each of the individual supplying paths 4 individually communicates a common liquid supplying chamber 10 with the pressure generating chambers 3 and includes a large diameter portion (4*a* in FIG. 6) having a relatively large diameter and a small diameter portion (4*b* in FIG. 6) having a relatively small diameter as to the size along the plate plane direction. Due to flow passage resistance at the small diameter portion 4*b*, the amount of ink flowing from the common liquid supplying chamber 10 to the pressure generating chambers 3 is controlled.

Each of the pressure generating chamber 3 communicates with one of a plurality of nozzles 1 made to the nozzle plate 2. The slit made to the flow passage plate 5 to form the individual supplying paths 4 and the pressure generating chambers 3 as the pressure generating chamber and the individual supplying paths forming members is processed by a precision press processing.

A vibration plate 8 as a liquid supplying chamber displacing film forming member includes a diaphragm film 7 to efficiently convey the displacement of a piezoelectric actuator 21 to the pressure generating chamber 3 and a plurality of individual supplying holes 6 existing at the border between the common liquid supplying chamber 10 and the individual supplying paths 4. The diaphragm film 7 is formed in the base material plate of the vibration plate 8 and has the same thickness of that of the base material plate. In the vibration plate 8, the portion thicker than the diaphragm film 7 is formed of the base material plate and the portion electrocoated by electrocasting to the base material plate. The individual supplying holes 6 are through holes and communicate the inside of the individual supplying paths 4 with the inside of the common liquid supplying chamber 10.

The manifold plate 11 as a common liquid supplying chamber forming member has a large through hole having a rectangular form that forms an actuator insertion portion 9 where a piezoelectric actuator 21 is inserted. In addition, a large through hole having a rectangular form that forms the common liquid supplying chamber 10 is also formed.

A damper plate 14 as a liquid supplying chamber displacement film forming member has a large through hole having a rectangular form that forms the actuator insertion portion 9. Moreover, two circular through holes to form each of two ink flow-in paths and a supplying damper film 13 as a liquid supplying chamber displacement film are formed. One of the two ink flow-in paths 12 communicates with one end of the common liquid supplying chamber 10 in the longitudinal direction and the other of the two ink flow-in paths 12 is disposed to communicate with the other end of the common liquid supplying chamber 10 in the longitudinal direction. In addition, the supplying damper film 13 is formed of the innocent area in the base material plate of the damper plate 14 and has the same thickness of that of the base material plate. In the damper plate 14, the portion thicker than the supplying damper film 13 is formed of the base material plate and the portion electrocoated by electrocasting to the base material plate.

A spacer plate 16 includes a concave portion to form a supplying damper chamber 15 to displace the supplying damper film 13 and a through hole communicating with the ink flow-in path 12.

A frame 18 made of stainless steel includes a through hole having a large rectangular form to constitute the actuator insertion portion 9 and two through holes to constitute ink guiding paths 17 to guide ink sent from the head tank 435 to the ink flow-in path 12. To form such through holes and slits, cutting, etc. are used. The through holes having a rectangular form to constitute the actuator insertion portion 9 is made to accommodate the entire of the piezoelectric actuator 21. It is also suitable to provide a plurality of separation walls to individually accommodate the piezoelectric elements 19 of the piezoelectric actuator 21 to enhance rigidity. This enhancement of rigidity makes it possible to reduce trouble ascribable to the mechanical factor of mutual interference between cross talk: channel (combination of the nozzle 1, the pressure generating chamber 3, the individual supplying path 4, and the piezoelectric element 19).

The piezoelectric actuator 21 includes a plurality of piezoelectric elements 19 individually corresponding to each of the plurality of nozzles 1 and a fixing member 20 to fix the piezoelectric element 19. One end surface of the piezoelectric element 19 is fixated to one end surface of the fixing member 20 with an adhesive and the other end surface of the piezoelectric element 19 is jointed with the diaphragm film 7. To each of the piezoelectric elements 19, individual electrodes individually provided for each element and a common electrode in common with each element are connected. To the individual electrodes, individual switching elements to individually control on and off of the power source are connected. These switching elements are disposed at a flexible printed circuit board. Due to this electrode configuration, each of the piezoelectric elements 19 can be individually driven (displaced), which makes it possible to individually change the ink pressure in the pressure generating chambers 3. Ink droplets are discharged from the nozzle 1 that communicates with the pressure generating chamber 3 under the ink pressure increased by the displacement of the piezoelectric element 19.

The transverse section illustrated in FIG. 6 is a cross section of a single channel. In addition, the portions illustrated as cross sections of each constituting part illustrated in FIGS. 4 and 5 correspond to the portion broken on A-A' line.

The ink guided from the head tank 435 to the ink guiding path 17 flows into the common liquid supplying chamber 10 by way of the ink flow-in path 12. Each of the large diameter portions 4*a* in the individual supplying paths 4 of each channel communicates with this common liquid supplying chamber 10 via the individual supplying holes 6. The ink flown from the common liquid supplying chamber 10 into the large diameter portion 4*a* of the individual supplying path 4 enters into the small diameter portion 4*b* and flows towards the pressure generating chamber 3 while receiving a flow passage resistance.

Next, the configuration of the image forming apparatus according to the first embodiment is described.

The supplying damper film 13 formed to the damper plate 14 serves as an inside wall of the upper wall of the common liquid supplying chamber 10 and also a liquid supplying chamber displacement film. The hollow supplying damper chamber 15 is adjacent to the common liquid supplying chamber 10 via the supplying damper film 13 so as to displace the supplying damper film 13 according to the change of the pressure of ink in the common liquid supplying chamber 10. When the ink pressure in the pressure generating chamber 3 due to the drive of the piezoelectric element 19, ink droplets are discharged from the nozzle 1 as described above. At this time, part of the ink in the pressure generating chamber 3 advances into the small diameter portion 4*b* of the individual supplying path 4 and slightly displaces the supplying damper film 13 towards the hollow supplying damper chamber 15 via the ink in the large diameter portion 4*a* and the ink in the common liquid supplying chamber 10. According to the supplying damper film 13 displaced due to the change in ink pressure in the common liquid supplying chamber 10, the amount of pressure change can be reduced.

The ink pressurized in the common liquid supplying chamber 10 pushes back the ink in the individual supplying path 4 and produces reflective wave in the pushed-back ink. This reflective wave reaches the nozzle 1 later than the pressure component (advancement component) ascribable to the displacement of the piezoelectric element 19. The reflective wave has an impact on the discharging amount and discharging speed of ink which determine the print quality. Since the force of the reflective wave depends on the number of channels driven at the same time, the discharging amount and discharging speed vary depending on the printing conditions. This leads to degradation of the print quality. In particular, if the drive frequency is set relatively high, the discharging of ink droplets completes before the reflective wave sufficiently decays, which significantly changes the discharging amount and discharging speed of the following ink droplets. In such a case, it is desirable to suppress occurrence of reflective wave by sensitively displacing the supplying damper film 13. However, if the supplying damper film 13 is thinned for this purpose, its mechanical strength deteriorates, so that the supplying damper film 13 is easily broken.

In the image forming apparatus according to the first embodiment, the individual supplying holes 6 existing on the border with the common liquid supplying chamber 10 in the individual supplying path 4 and the supplying damper film 13 face each other via the ink in the common liquid supplying chamber 10 as illustrated. This makes it possible to make the supplying damper film 13 receive the pressure applied to the ink in the common liquid supplying chamber 10 around the individual supplying holes 6 by the ink in the large diameter portion 4*a* of the individual supplying path 4 without changing the direction. In such a configuration, in comparison with atypical configuration in which the individual supplying hole 6 is configured not to face the supplying damper film 13 so that the supplying damper film 13 receives the pressure applied to the ink in the common liquid supplying chamber 10 after the pressure direction is changed around the individual supplying hole 6, the supplying damper film 13 is sensitively displaced. That is, since the supplying damper film 13 can be sensitively displaced without thinning the thickness of the supplying damper film 13, it is possible to suppress the occurrence of breakage of the supplying damper film 13 ascribable to the thinned thickness.

Japanese Patent No. 3680394, Japanese Patent No. 3562080, and Unexamined Japanese Patent Application Publication No. 2010-194797 disclose inkjet heads, any of which forms a diaphragm film operating as a displacement film for discharging and a supplying damper film operating as a liquid supplying displacement film on the same plate. In such a configuration, if the diaphragm film and the supplying damper film are configured by a base material plate and the portion therearound is hilled by electrocasting, the thickness of the films is inevitably the same.

If the damper film is thin, absorption property of pressure change is improved. However, the diaphragm film is also thin, which degrades the ink dischargeability. That is, there is a trade-off between absorption property of pressure change and dischargeability.

On the other hand, in the image forming apparatus according to the first embodiment of the present disclosure, since the diaphragm film 7 and the supplying damper film 13 are formed on separate plates, it is possible to form each film having a suitable thickness even when electrocasting is adopted for the processing method. Therefore, it is possible to set a suitable mechanical compliance value for each film to strike a balance between absorption property for pressure change and dischargeability.

As illustrated in FIG. 4 and FIG. 5, the supplying damper film has a width (dimension long traverse direction) W, a longitudinal dimension L, and a thickness T. In general, the damper performance is determined by the value of the mechanical compliance.

The mechanical compliance C of the supplying damper film 13 is represented by the following relation.

$$C=8\times L\times W^5/(15\times 35\times E\times t^3)$$

In the relation, L represents the longitudinal dimension of a damper. W represents the width of the damper.

E represents a young's modulus of the film. t represents the thickness of the film. The mechanical compliance C of the diaphragm film 7 can be obtained in the same manner. The entire mechanical compliance C of the plurality of diaphragm films 7 can be obtained by addition of individual mechanical compliances. The parameters having a large impact on the compliance performance are the width W and the thickness t of the film. As the width W of a damper increases, the mechanical compliance C increases. In addition, as the thickness t of a film decreases, the mechanical compliance C increases.

In addition, the inkjet head disclosed in Unexamined Japanese Patent Application Publication No. 2010-194797 has a configuration in which part of the area of the nozzle plate of the head is thinned to form a damper chamber. The nozzle plate is pressurized when a recording sheet of thick paper, etc. is pressed against the nozzle plate due to paper jamming, etc. This pressure may cause damage to the thin portion. Moreover, due to the weakness of the rigidity of the thin portion, the pressure during jointing of multiple plates is not sufficiently applied, which may result in defective jointing.

To the contrary, the image forming apparatus according to this embodiment of the present disclosure, since no thin portion for the damper chamber is formed on the nozzle plate, breakage of the nozzle plate 2 is prevented. In addition, since the pressure for jointing can be sufficiently applied, it is possible to prevent occurrence of defective jointing. In particular, since the spacer plate 16 having a thin portion for the hollow supplying damper chamber 15 is directly stacked on the frame 18 as a rigid holding member to protect the spacer plate 16, the occurrence of the breakage of the spacer plate 16 having a thin portion can be also prevented.

Line printers having multiple liquid droplet discharging heads are now commercialized to print a color image in a single scanning. Since such line printers have many liquid droplet discharging heads arranged, the two dimensional size of the liquid droplet discharging head is demanded to be small and narrow. In particular, in the case in which nozzle lines are disposed perpendicular to the printing direction, printers become large if the gap between heads is large. In addition, as the gap between the heads increases, the variation of conveyance has a large impact, so that the print dot positions are displaced. Therefore, two-dimensional size of the head is desired to be small.

In the image forming apparatus according to the first embodiment, since the pressure generating chamber 3 and the individual supplying path 4 and the common liquid supplying chamber 10 are formed in the separate plates, which are stacked, the size of the head is reduced in comparison with the case in which these are arranged side by side.

In addition, in the image forming apparatus according to the first embodiment, the common liquid supplying chamber 10 is formed extending in the arrangement direction of the individual supplying paths 4 and each of the individual supplying holes 6 is set to face towards the center of the supplying damper film 13 in the width direction. The center of the supplying damper film 13 is the most flexible portion of all of the areas in the width direction. Therefore, among all of the areas of the individual supplying holes 6, the supplying damper film 13 can be sensitively displaced in comparison with the case in which the individual supplying holes 6 are set to face a portion other than the center.

Next, variation embodiments of the image forming apparatus in each of which part of the configuration of the liquid droplet discharging head 434 of the image forming apparatus according to the first embodiment is changed are separately described. The configuration of the image forming apparatus according to each variation embodiment is the same as those of the embodiment unless otherwise specified.

The image forming apparatus of the first variation embodiment is described first.

Figure 7:
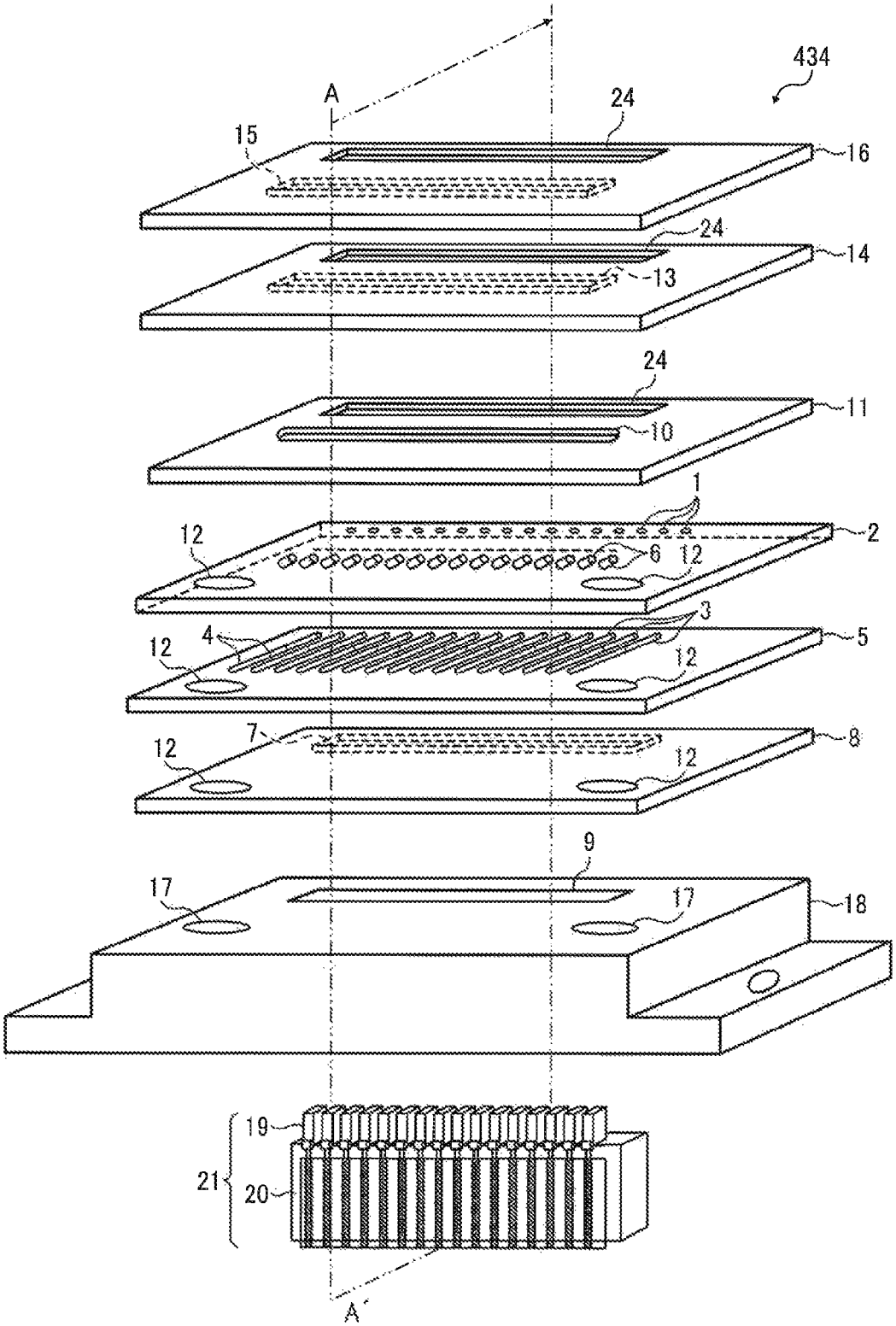
FIG. 7 is an exploded perspective view of an example of the liquid droplet discharging head of the image forming apparatus according to a first variation embodiment of the present disclosure.
Figure 8:
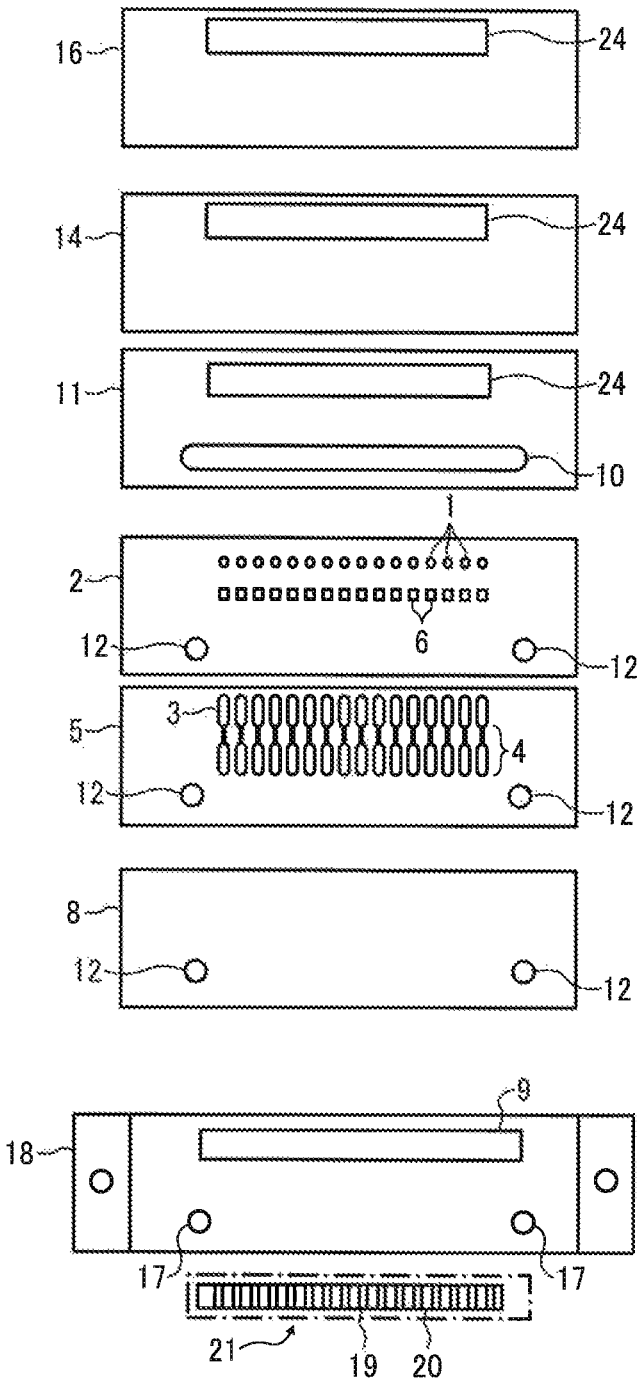
FIG. 8 is an exploded planar view of each plate-like form member of the liquid droplet discharging head illustrated in FIG. 3 from the nozzle side.
Figure 9:
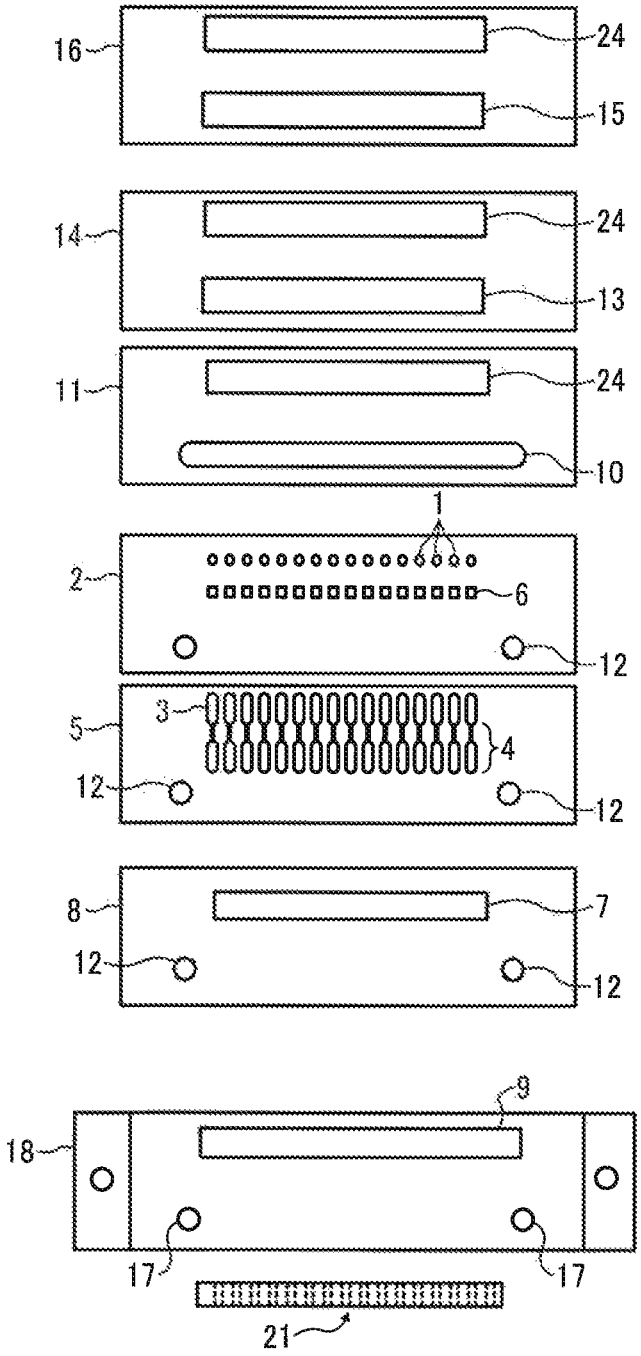
FIG. 9 is an exploded view of each plate-like form member of the liquid droplet discharging head illustrated in FIG. 3 from the layered piezoelectric element side.
Figure 10:
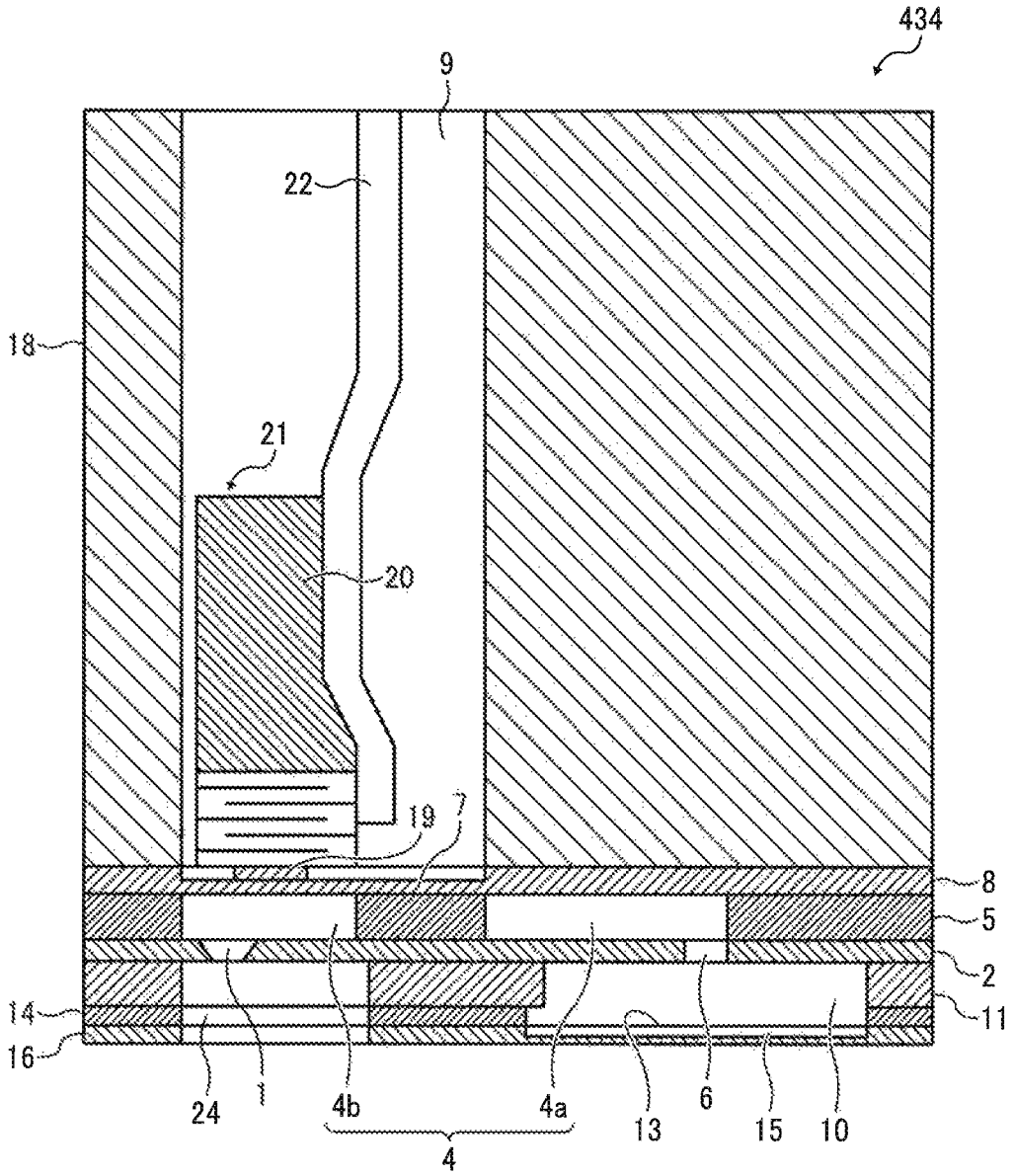
FIG. 10 is an A-A' cross section illustrating the liquid droplet discharging head illustrated in FIG. 7.

FIG. 7 is an exploded perspective view of the liquid droplet discharging head 434 of the image forming apparatus according to the first variation embodiment of the present disclosure. In addition, FIG. 8 is an exploded planar view of each plate-like form member of the liquid droplet discharging head 434 from the nozzle side. FIG. 9 is an exploded planar view of each plate-like form member of the liquid droplet discharging head 434 from the layered piezoelectric element side. FIG. 10 is an A-A' cross section illustrating the liquid droplet discharging head illustrated in FIG. 7.

The image forming apparatus according to the first variation embodiment includes the frame 18 on which the vibration plate 8, the flow passage plate 5, the nozzle plate 2, the manifold plate 11, the damper plate 14, and the spacer plate 16 are stacked in this sequence.

Unlike the embodiment, the vibration plate 8 includes two circular through holes to constitute the two ink flow-in paths 12 instead of the individual supplying holes 6.

In addition, the flow passage plate 5 includes two circular through holes to constitute the two ink flow-in paths 12 in addition to the combination of the pressure generating chambers 3 and the individual supplying paths 4. In addition, the nozzle plate 2 includes a plurality of through holes to constitute individual supplying holes 6 and two circular through holes to constitute the two ink flow-in paths 12 in addition to the nozzles 1. Moreover, the manifold plate 11 has a large through hole to constitute the common liquid supplying chamber 10 but no through hole to constitute the actuator insertion portion 9. Instead, a large through hole is formed to constitute a large discharging slit 24 to pass ink droplets discharged from the nozzle 1. In addition, the damper plate 14 includes the supplying damper film 13 but no through hole to constitute the ink flow-in path 12 or the actuator insertion portion 9.

Instead, a large through hole is formed to constitute the large discharging slit 24. In addition, the spacer plate 16 includes a concave portion to form the hollow supplying damper chamber 15 to displace the supplying damper film 13 but no through hole to constitute the ink flow-in path 12 or the actuator insertion portion 9. Instead, a large through hole is formed to constitute the large discharging slit 24.

As illustrated in FIG. 10, the common liquid supplying chamber 10, the supplying damper film 13, and the hollow supplying damper chamber 15 are formed on the position closer to the ink discharging side than the nozzle 1. However, the individual supplying holes 6 face the supplying damper film 13 in the traverse direction like the first embodiment. Therefore, as in the first embodiment, it is possible to sensitively displace the supplying damper film 13.

In addition, in the image forming apparatus according to the first variation embodiment, the damper plate 14 and the spacer plate 16 can be operated as a spacer to adjust the distance between the nozzle 1 and the recording sheet.

The image forming apparatus of the second variation embodiment is described next.

Figure 11:
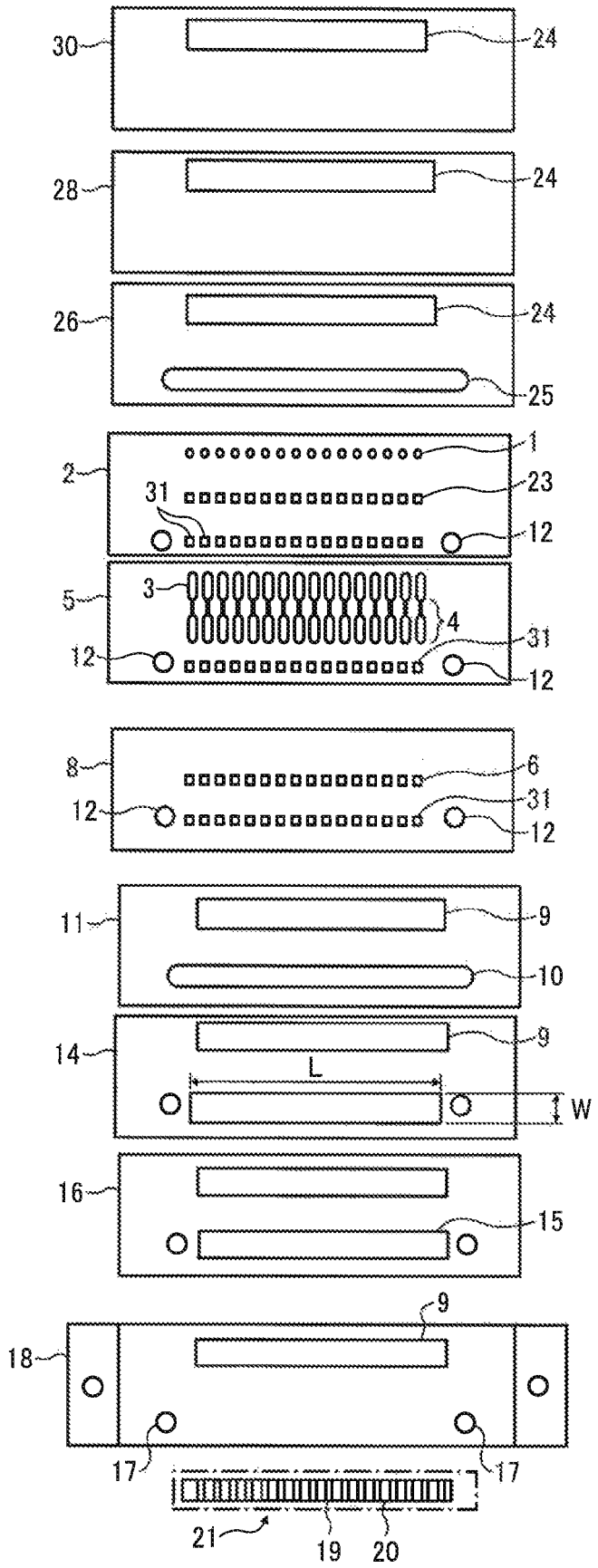
FIG. 11 is an exploded planar view of each plate-like form member of the liquid droplet discharging head of the image forming apparatus according to a second variation embodiment of the present disclosure.
Figure 12:
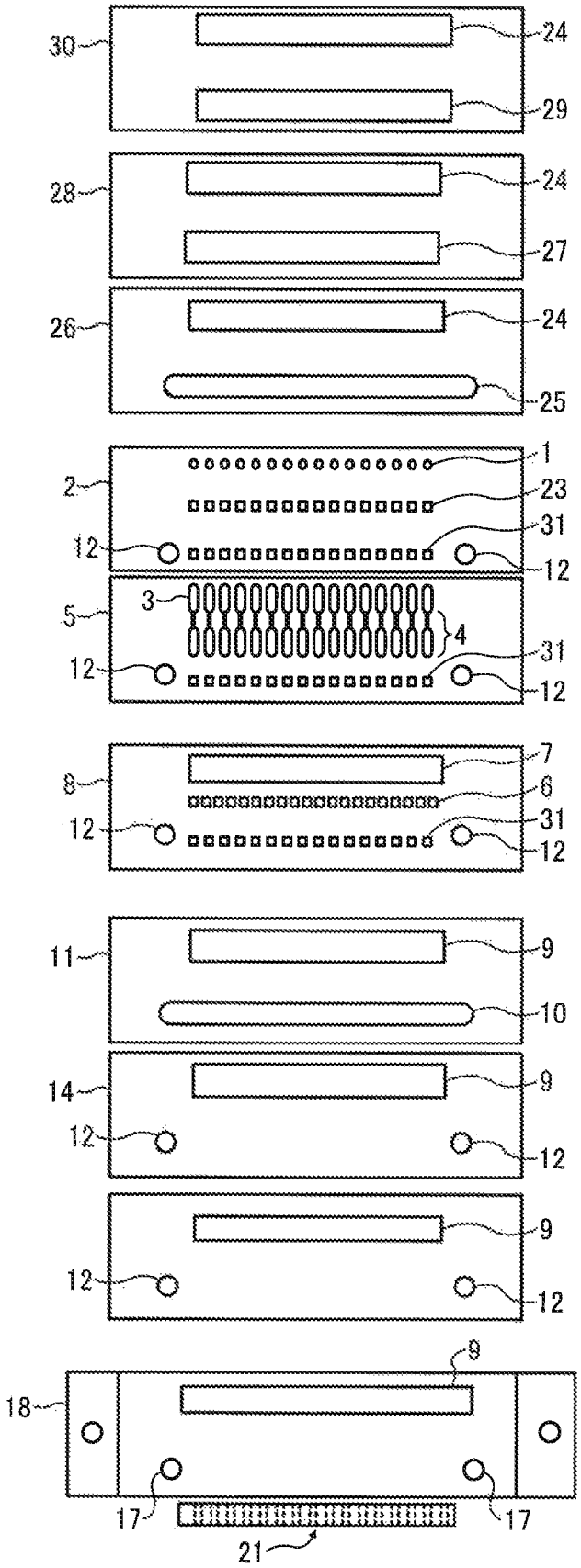
FIG. 12 is an exploded view of each plate-like form member of the liquid droplet discharging head illustrated in FIG. 3 from the layered piezoelectric element side.
Figure 13:
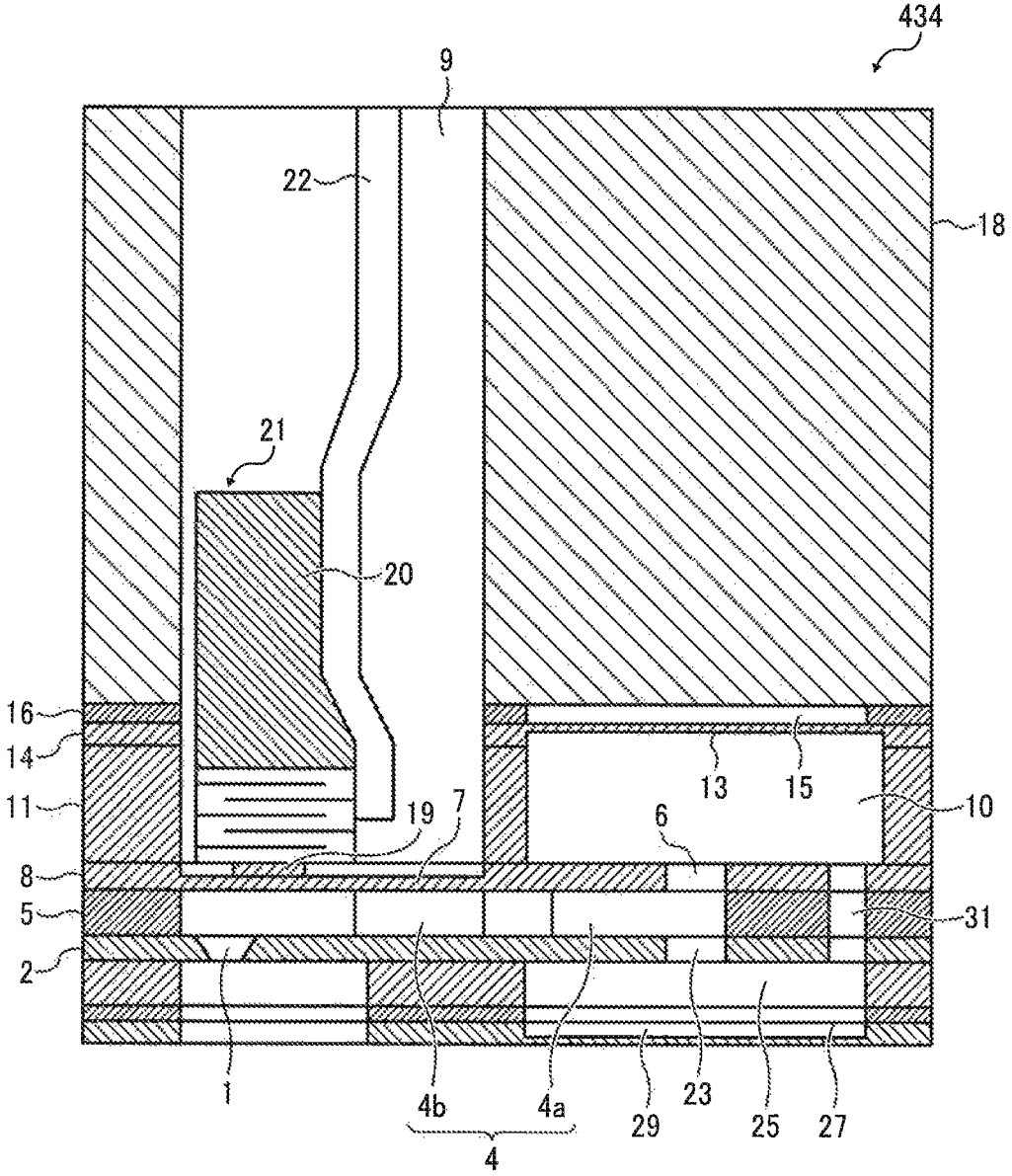
FIG. 13 is a cross section illustrating the liquid droplet discharging head illustrated in FIG. 3.

FIG. 11 is an exploded planar view of each plate-like form member of the liquid droplet discharging head of the image forming apparatus according to the second variation embodiment of the present disclosure. FIG. 12 is an exploded planar view of each plate-like form member of the liquid droplet discharging head 434 from the layered piezoelectric element side. FIG. 13 is a cross section illustrating the liquid droplet discharging head 434 illustrated in FIG. 3.

In the image forming apparatus according to the second variation embodiment, the configuration of the frame 18, the spacer plate 16, the damper plate 14, and the manifold plate 11 are the same as those of the image forming apparatus of the embodiment according to the first embodiment.

In addition to the individual supplying holes 6 and the concave portion to constitute the diaphragm film 7, the vibration plate 8 includes the following, which is not formed in the first embodiment. They are two circular through holes to constitute the two ink flow-in paths 12 and a plurality of circulation paths 31 individually corresponding to each of the individual supplying paths 4.

Also, in addition to a plurality of slits to constitute the pressure generating chambers 3 and the individual supplying paths 4, the flow passage plate 5 includes the following, which is not formed in the embodiment. They are two circular through holes to constitute the two ink flow-in paths 12 and a plurality of circulation paths 31 individually corresponding to each of the individual supplying paths 4.

Also, in addition to the nozzles 1, the nozzle plate 2 includes the following, which is not formed in the embodiment. They are a plurality of individual retrieving holes 23 to individually communicate the individual supplying paths 4 with a common liquid retrieving chamber 25, a plurality of through holes to constitute a plurality of circulation path 31, and two circular through holes to constitute the two ink flow-in paths 12.

The image forming apparatus according to the second variation embodiment includes a retrieving manifold plate 26, a retrieving damper plate 28, and a retrieving spacer plate 30 stacked in this sequence on the discharging side of the nozzle plate 2.

The retrieving manifold plate 26 includes a large through hole to constitute the common liquid retrieving chamber 25 which communicates with a plurality of individual supplying paths 4 via a plurality of individual retrieving holes 23. In addition, a large through hole is formed to constitute the large discharging slit 24 to pass ink droplets discharged from the nozzle 1. In addition, the retrieving damper plate 28 includes a concave portion to constitute a retrieving damper film 27 and a large through hole formed to constitute the large discharging slit 24. In addition, the retrieving spacer plate 30 includes a concave portion to constitute a retrieving damper chamber 29 and a large through hole formed to constitute the large discharging slit 24.

In the image forming apparatus according to the second variation embodiment, the ink flow-in path 12 communicates with the common liquid supplying chamber 10 and also the common liquid retrieving chamber 25. In FIG. 13, when the drive of the piezoelectric element 19 increases the pressure of the ink in the pressure generating chamber 3, ink droplets are discharged from the nozzle 1 and pant of the ink in the pressure generating chamber 3 returns from the individual supplying paths 4 to the common liquid supplying chamber 10, which are already described. At this time, in the image forming apparatus according to the second variation embodiment, the following phenomenon may occur. That is, part of the ink in the pressure generating chamber 3 moves to the individual supplying paths 4 together with air bubbles. In addition, the ink in the large diameter portion 4*a* of the individual supplying paths 4 is retrieved into the common liquid retrieving chamber 25 via the individual retrieving hole 23. At this time, part of the air bubbles in the individual supplying paths 4 is collected into the common liquid retrieving chamber 25. The ink and the air bubble retrieved in the common liquid retrieving chamber 25 thereafter circulate in the common liquid supplying chamber 10 via the circulation path 31 and the ink flow-in path 12.

The image forming apparatus according to the second variation embodiment retrieves air bubbles in the pressure generating chamber 3 into the common liquid retrieving chamber 25 so that non-discharging ascribable to the air bubbles can be prevented without wasting ink. When many air bubbles circulate from the common liquid retrieving chamber 25 to the common liquid supplying chamber 10, it is suitable to provide a defoaming device working on mechanical principle in the common liquid retrieving chamber 25 or the circulation path 31 to accelerate defoaming.

In addition, due to ink circulation, the image forming apparatus according to the second variation embodiment s it possible to conduct the following. That is, moreover, when ink of particular color such as white including ink particles which easily precipitate or ink including functional particulates which easily precipitate such as liquid application including spacer beads for use in manufacturing of liquid crystal mother boards, it is possible to suppress precipitation of the ink particles and the functional particulates.

In the image forming apparatus according to the second variation embodiment, when ink moves from the individual supplying paths 4 to the common liquid retrieving chamber 25 and pressure of the ink in the common liquid retrieving chamber 25 increases, the retrieving damper film 27 constituting part of the inside wall of the common liquid retrieving chamber 25 is displaced. Accordingly, the momentum of reflective wave generated from the common liquid retrieving chamber 25 to the pressure generating chamber 3 when the pressure of the ink in the pressure generating chamber 3 returns to normal can be lessened.

In addition, in the image forming apparatus according to the second variation embodiment, since the individual retrieving hole 23 faces the center of the retrieving damper film 27 in the traverse direction, the retrieving damper film 27 can be sensitively displaced like the supplying damper film 13.

In the embodiment and the variation embodiments, the present disclosure is applied to the image forming apparatus having a printer configuration but is not limited thereto. For example, the present disclosure can be applied to an image forming apparatus such as a multifunction peripheral having printer function, facsimile function, and photocopying function.

The above-described is just an example and the following embodiments have their own peculiar features.

Embodiment A

The liquid droplet discharging head of Embodiment A includes a plurality of discharging holes (for example, nozzles 1) to discharge a liquid droplet, a plurality of pressure generating chambers (for example, the pressure generating chambers 3) that individually communicate with the plurality of discharging holes to apply a pressure to liquid inside the liquid droplet discharging head, a common liquid supplying chamber (for example, the common liquid supplying chamber 10) to accommodate the liquid to be supplied to the plurality of pressure generating chambers, a plurality of individual supplying paths (for example, the individual supplying paths 4) to communicate the plurality of pressure generating chambers with the common liquid supplying chamber, a displacing film (for example, the diaphragm film 7) for discharging which constitutes part of the inside wall of each of the plurality of pressure generating chambers to displace itself to individually apply a pressure to the liquid inside the plurality of pressure generating chambers to discharge the liquid from the plurality of discharging holes, a liquid supplying chamber displacing film (for example, supplying damper film) which constitutes part of the inside wall of the common liquid supplying chamber to displace itself according to pressure change of the liquid in the common liquid supplying chamber, and a plurality of individual supplying holes (for example, individual supplying holes 6) existing at each border between the plurality of individual supplying paths and the common liquid supplying chamber. The plurality of individual supplying holes face the liquid supplying chamber displacing film via the liquid in the common liquid supplying chamber.

In Embodiment A, the liquid supplying chamber displacing film receives the pressure of the liquid in the individual supplying paths applied to the liquid in the common liquid supplying chamber around the individual supplying holes without changing its direction. As a result, in comparison with a typical configuration in which the individual supplying holes are configured not to face the liquid supplying chamber displacing film so that the liquid supplying chamber displacing film receives the pressure applied to the ink in the common liquid supplying chamber after the pressure direction is changed around the individual supplying holes, the liquid supplying chamber displacing film is sensitively displaced. In such a configuration, since the liquid supplying chamber displacing film can be sensitively displaced without thinning the liquid supplying chamber displacing film, it is possible to suppress the occurrence of breakage of the liquid supplying chamber displacing film ascribable to the thinned thickness.

Embodiment B

The liquid droplet discharging head of Embodiment B further includes a common liquid retrieving chamber (for example, the common liquid retrieving chamber 25) to accommodate the liquid retrieved from each of the plurality of pressure generating chambers, a plurality of individual retrieving paths (for example, the individual retrieving holes 23) to individually communicate each of the plurality of pressure generating chambers with the common liquid retrieving chamber, and a liquid retrieving chamber displacing film (for example, the retrieving damper film 27) constituting at least part of the inside wall of the common liquid supplying chamber to displace itself according to pressure change of the liquid in the common liquid retrieving chamber, in addition to Embodiment A. In such a configuration, as described in the second variation embodiment, it is possible to suppress occurrence of non-discharging ascribable to air bubbles without wasting the ink. Moreover, it is also possible to suppress generation of reflective wave from the common liquid retrieving chamber to the pressure generating chamber via the individual retrieving paths.

Embodiment C

The liquid droplet discharging head of Embodiment C, wherein individual retrieving holes (for example, the individual retrieving holes 23) existing at each border between the plurality of individual retrieving paths and the common liquid retrieving chamber face the liquid retrieving chamber displacing film via the liquid in the common liquid retrieving chamber, in addition to the configuration of Embodiment B. In such a configuration, it is possible to suppress occurrence of breakage of the liquid retrieving chamber displacing film ascribable to the thinned thickness of the liquid retrieving chamber displacing film while sensitively displacing the liquid retrieving chamber displacing film.

Embodiment D

The liquid droplet discharging head of Embodiment D further includes a discharging slit forming member (for example, the nozzle plate 2) to which the plurality of discharging slits are formed, a liquid supplying chamber displacing film forming member (for example, the damper plate 14) to which the liquid supplying chamber displacing film it formed, a hollow portion forming member (for example, the spacer plate 16) to which a hollow portion is formed to displace the liquid supplying chamber displacing film, and a common holding member (for example, the frame 18) on which the discharging slit forming member, the liquid supplying chamber displacing film forming member, and the hollow portion forming member are stacked in such a manner that the hollow portion forming member is directly stacked on the common holding member, in addition to any of Embodiment A to C. In such a configuration, as described in the first embodiment, since the hollow portion forming member having a thin portion to form a hollow portion is directly stacked on the rigid holding member to protect the hollow portion forming member, occurrence of the breakage of the hollow portion forming member having a thin portion can be prevented.

Embodiment E

The liquid droplet discharging head of embodiment E further includes a discharging slit forming member to which the plurality of discharging slits are formed, a liquid supplying chamber displacing film forming member to which the liquid supplying chamber displacing film is formed, a hollow portion forming member including a hollow portion to displace the liquid supplying chamber displacing film, and a holding member on which the discharging slit forming member, the liquid supplying chamber displacing film forming member, and the hollow portion forming member are stacked in such a manner that the liquid supplying chamber displacing film and the hollow portion forming member are stacked close to the liquid droplet discharging side in comparison with the discharging slit forming member, in addition to any of Embodiment A to C.

In such a configuration, as described in the first variation embodiment, the liquid supplying chamber displacing film and the hollow portion forming member can be served as the spacer member to adjust the distance between the discharging slit and the recording sheet.

Embodiment F

In the liquid discharging head of Embodiment F, the common liquid supplying chamber is formed extending along the arrangement direction of the plurality of individual supplying paths and each of the plurality of individual supplying holes is disposed facing the center portion of the liquid supplying chamber displacing film in a traverse direction, in addition to any of Embodiment A to E. In such a configuration, as described in the first embodiment, it is possible to displace the liquid supplying chamber displacing film more sensitively than the configuration in which the individual supplying paths do not face the center portion of the liquid supplying chamber displacing film in the traverse direction.

Embodiment G

In the liquid discharging head of Embodiment G, the displacing films for discharging and the liquid supplying chamber displacing film have different mechanical compliances, in addition to any of Embodiment A to F. In such a configuration, it is possible to individually make each of the displacing films for discharging and the liquid supplying chamber displacing film demonstrate suitable features.

Embodiment H

In the liquid discharging head of Embodiment H, the displacing film for discharging and the liquid supplying chamber displacing film have different thicknesses, in addition to Embodiment G. In such a configuration, it is possible to easily adjust the ratio of the mechanical compliance of the discharging film for discharging and the mechanical compliance of the liquid supplying chamber displacing film.

Embodiment I

In the liquid discharging head of Embodiment I, the displacing film for discharging and the liquid supplying chamber displacing film are made of different materials, in addition to Embodiment G. In such a configuration, it is possible to easily adjust the ratio of the mechanical compliance of the discharging film for discharging and the mechanical compliance of the liquid supplying chamber displacing film.

The image forming apparatus of Embodiment J includes a liquid droplet discharging head (for example, the liquid droplet discharging head 434) to discharge a liquid droplet from a plurality of discharging slits, a recording sheet conveying device to convey a recording sheet, and a head moving device to move the liquid droplet discharging head along the plane of the recording sheet in the direction perpendicular to the conveying direction by the recording sheet conveying device, wherein the image forming device forms an image on the recording sheet with the liquid droplet discharged from the plurality of discharging slits.

According to the present invention, it is possible to prevent occurrence of breakage of a liquid supplying chamber displacing film while sensitively displacing the liquid supplying chamber displacing film of a damper member, etc. in response.

Having now fully described embodiments of the present invention, it will be apparent to one of ordinary skill in the art that many changes and modifications can be made thereto without departing from the spirit and scope of embodiments of the invention as set forth herein.

What is claimed is:

1. A liquid droplet discharging head comprising:

a plurality of discharging orifices configured to discharge a liquid droplet;

a plurality of pressure generating chambers that apply a pressure to liquid inside the liquid droplet discharging head and individually communicate with the plurality of respective discharging orifices;

a common liquid supplying chamber configured to accommodate the liquid to be supplied to the plurality of pressure generating chambers;

a plurality of individual supplying paths configured to communicate the plurality of pressure generating chambers with the common liquid supplying chamber;

each pressure generating chamber amongst the plurality of pressure generating chambers including a corresponding displacing film for discharging which constitutes part of an inside wall of the corresponding pressure generating chamber, the displacing film for discharging configured to conduct self displacement to individually apply a pressure to the liquid inside the corresponding pressure generating chamber to discharge the liquid from a corresponding discharging orifice amongst the plurality of discharging orifices;

a liquid supplying chamber displacing film which constitutes part of an upper wall portion of an inside wall of the common liquid supplying chamber, the liquid supplying chamber displacing film configured to conduct self displacement according to pressure change of the liquid in the common liquid supplying chamber; and a plurality of individual supplying holes disposed (i) in a lower wall portion of the inside wall of the common liquid supplying chamber and (ii) at each border between the plurality of individual supplying paths and the common liquid supplying chamber, the plurality of individual supplying holes disposed in said lower wall portion facing, in a direction opposite to a discharging direction of the liquid droplet, said upper wall portion.

2. The liquid droplet discharging head according to claim 1, further comprising:

a discharging orifice forming member including the plurality of discharging orifices;

a liquid supplying chamber displacing film forming member including the liquid supplying chamber displacing film;

a hollow portion forming member including a hollow portion configured to displace the liquid supplying chamber displacing film; and a common holding member on which the discharging orifice forming member, the liquid supplying chamber displacing film forming member, and the hollow portion forming member are stacked in such a manner that the liquid supplying chamber displacing film and the hollow portion forming member are stacked close to a liquid droplet discharging side in comparison with the discharging orifice forming member.

3. The liquid discharging head according to claim 1, wherein the common liquid supplying chamber is formed extending along an arrangement direction of the plurality of individual supplying paths and each of the plurality of individual supplying holes is disposed facing a center portion of the liquid supplying chamber displacing film in a traverse direction.

4. The liquid discharging head according to claim 1, wherein the displacing film for discharging and the liquid supplying chamber displacing film have different mechanical compliances.

5. The liquid discharging head according to claim 1, wherein the displacing film for discharging and the liquid supplying chamber displacing film have different thicknesses.

6. The liquid discharging head according to claim 1, wherein the displacing film for discharging and the liquid supplying chamber displacing film are formed of different materials.

7. An image forming apparatus comprising:

the liquid droplet discharging head of claim 1 configured to discharge the liquid droplet from the plurality of discharging orifices;

a recording sheet conveying device configured to convey a recording sheet; and a head moving device configured to move the liquid droplet discharging head along a plane of the recording sheet in a direction perpendicular to a conveying direction by the recording sheet conveying device, wherein the image forming apparatus forms an image on the recording sheet with the liquid droplet discharged from the plurality of discharging orifices.

8. The liquid discharging head according to claim 1, wherein each pressure generating chamber amongst the plurality of pressure generating chambers individually communicates with a respective discharging orifice amongst the plurality of discharging orifices to discharge a respective liquid droplet when the displacing film of the respective pressure generating chamber conducts self displacement to individually apply a pressure to the liquid inside the respective pressure generating chamber.

9. A liquid droplet discharging head comprising:

a plurality of discharging orifices configured to discharge a liquid droplet;

a plurality of pressure generating chambers that individually communicate with the plurality of discharging orifices, the plurality of pressure generating chamber configured to apply a pressure to liquid inside the liquid droplet discharging head;

a common liquid supplying chamber configured to accommodate the liquid to be supplied to the plurality of pressure generating chambers;

a plurality of individual supplying paths configured to communicate the plurality of pressure generating chambers with the common liquid supplying chamber;

a displacing film for discharging which constitutes part of an inside wall of each of the plurality of pressure generating chambers, the displacing film for discharging configured to conduct self displacement to individually apply a pressure to the liquid inside the plurality of pressure generating chambers to discharge the liquid from the plurality of discharging orifices;

a liquid supplying chamber displacing film which constitutes part of an inside wall of the common liquid supplying chamber, the liquid supplying chamber displacing film configured to conduct self displacement according to pressure change of the liquid in the common liquid supplying chamber; and a plurality of individual supplying holes existing at each border between the plurality of individual supplying paths and the common liquid supplying chamber, the plurality of individual supplying holes facing the liquid supplying chamber displacing film via the liquid in the common liquid supplying chamber;

a common liquid retrieving chamber configured to accommodate the liquid retrieved from each of the plurality of pressure generating chambers, a plurality of individual retrieving paths configured to individually communicate each of the plurality of pressure generating chambers with the common liquid retrieving chamber, and a liquid retrieving chamber displacing film which constitutes at least part of an inside wall of the common liquid retrieving chamber, the liquid retrieving chamber displacing film configured to conduct self displacement according to pressure change of the liquid in the common liquid retrieving chamber.

10. The liquid droplet discharging head according to claim 9, further comprising:

a plurality of individual retrieving holes existing at each border between the plurality of individual retrieving paths and the common liquid retrieving chamber, the plurality of individual retrieving holes facing the liquid retrieving chamber displacing film via the liquid in the common liquid retrieving chamber.

11. An image forming apparatus comprising:

the liquid droplet discharging head of claim 9 configured to discharge the liquid droplet from the plurality of discharging orifices;

a recording sheet conveying device configured to convey a recording sheet; and a head moving device configured to move the liquid droplet discharging head along a plane of the recording sheet in a direction perpendicular to a conveying direction by the recording sheet conveying device, wherein the image forming apparatus forms an image on the recording sheet with the liquid droplet discharged from the plurality of discharging orifices.

12. A liquid droplet discharging head comprising:

a plurality of discharging orifices configured to discharge a liquid droplet;

a plurality of pressure generating chambers that individually communicate with the plurality of discharging orifices, the plurality of pressure generating chamber configured to apply a pressure to liquid inside the liquid droplet discharging head;

a common liquid supplying chamber configured to accommodate the liquid to be supplied to the plurality of pressure generating chambers;

a plurality of individual supplying paths configured to communicate the plurality of pressure generating chambers with the common liquid supplying chamber;

a displacing film for discharging which constitutes part of an inside wall of each of the plurality of pressure generating chambers, the displacing film for discharging configured to conduct self displacement to individually apply a pressure to the liquid inside the plurality of pressure generating chambers to discharge the liquid from the plurality of discharging orifices;

a liquid supplying chamber displacing film which constitutes part of an inside wall of the common liquid supplying chamber, the liquid supplying chamber displacing film configured to conduct self displacement according to pressure change of the liquid in the common liquid supplying chamber; and a plurality of individual supplying holes existing at each border between the plurality of individual supplying paths and the common liquid supplying chamber, the plurality of individual supplying holes facing the liquid supplying chamber displacing film via the liquid in the common liquid supplying chamber;

a discharging orifice forming member including the plurality of discharging orifices;

a liquid supplying chamber displacing film forming member including the liquid supplying chamber displacing film;

a hollow portion forming member including a hollow portion configured to displace the liquid supplying chamber displacing film, and a common holding member on which the discharging orifice forming member, the liquid supplying chamber displacing film forming member, and the hollow portion forming member are stacked in such a manner that the hollow portion forming member is directly stacked on the common holding member.

13. An image forming apparatus comprising:

the liquid droplet discharging head of claim 12 configured to discharge the liquid droplet from the plurality of discharging orifices;

a recording sheet conveying device configured to convey a recording sheet; and a head moving device configured to move the liquid droplet discharging head along a plane of the recording sheet in a direction perpendicular to a conveying direction by the recording sheet conveying device, wherein the image forming apparatus forms an image on the recording sheet with the liquid droplet discharged from the plurality of discharging orifices.

* * * * *